US006569822B1

(12) United States Patent
Guillemet

(10) Patent No.: US 6,569,822 B1
(45) Date of Patent: May 27, 2003

(54) CONCENTRATED LIQUID COMPOSITIONS OF DIACETATES OF ALKYLPROPYLENE DIAMINES WHICH ARE EASILY DILUTABLE IN WATER

(75) Inventor: Francois Guillemet, Paris (FR)

(73) Assignee: Atofina, Puteaux (FR)

( * ) Notice: Subject to any disclaimer, the term of this patent is extended or adjusted under 35 U.S.C. 154(b) by 0 days.

(21) Appl. No.: 09/980,859

(22) PCT Filed: Jun. 6, 2000

(86) PCT No.: PCT/FR00/01547

§ 371 (c)(1),
(2), (4) Date: Mar. 18, 2002

(87) PCT Pub. No.: WO00/75266

PCT Pub. Date: Dec. 14, 2000

(30) Foreign Application Priority Data

Jun. 8, 1999 (FR) ..... 99 07207

(51) Int. Cl.[7] ..... C10M 129/08; C10M 133/02; C10M 173/02

(52) U.S. Cl. ..... 508/527; 508/579; 508/583

(58) Field of Search ..... 508/527

(56) References Cited

U.S. PATENT DOCUMENTS

| | | | | | |
|---|---|---|---|---|---|
| 4,371,446 | A | * | 2/1983 | Kinoshita et al. | 508/527 |
| 4,537,694 | A | * | 8/1985 | Horodysky | 508/527 |
| 4,839,067 | A | * | 6/1989 | Jansen | 508/527 |
| 4,849,119 | A | * | 7/1989 | Horodysky | 508/527 |
| 5,073,280 | A | * | 12/1991 | Rossio et al. | 508/527 |
| 5,174,914 | A | * | 12/1992 | Gutzmann | 508/527 |
| 5,182,035 | A | * | 1/1993 | Schmidt et al. | 508/527 |

FOREIGN PATENT DOCUMENTS

| | | |
|---|---|---|
| DE | 39 05 548 | 9/1990 |
| EP | 0 372 628 | 11/1990 |
| WO | WO 92/13050 | 8/1992 |
| WO | WO 95/26389 | 10/1995 |

* cited by examiner

*Primary Examiner*—Ellen M. McAvoy
(74) *Attorney, Agent, or Firm*—Smith, Gambrell & Russell, LLP

(57) ABSTRACT

It is possible to make very concentrated solutions of N-coco-, N-oleyl- or N-tallow-propylenediamine acetate which can be diluted without formation of gels or of lumps in a water/dissolving agent solvent. A simple dilution test is given which allows the suitable compositions to be selected. Use of their diluted solutions, in particular for the lubrication of bottles on conveyor lines.

6 Claims, No Drawings

CONCENTRATED LIQUID COMPOSITIONS OF DIACETATES OF ALKYLPROPYLENE DIAMINES WHICH ARE EASILY DILUTABLE IN WATER

FIELD OF THE INVENTION

The present invention relates to the production of concentrated aqueous solutions of organic salts of alkylpropylenediamines, more precisely of acetates of N-coco-, N-oleyl- or of N-tallow-1,3-diaminopropanes.

BACKGROUND OF THE INVENTION

Solutions of this type are used as stock solutions for the preparation of lubricating solutions intended to facilitate the contact sliding between solid surfaces such as glass, metals, polymers (polyethylene terephthalates, for example). In particular, these are solutions of the type which are used to ensure the lubrication of bottles on conveyor lines during bottling, cleaning, filling and labelling operations. For these operations, fatty acid soaps, which are too sensitive to multivalent ions and to which it was necessary to add complexing agents, phosphates and EDTA, which at the same time are costly and ecologically not very recommendable and which, in addition, have a strong tendency to promote bacterial proliferation, have been abandoned. Recognition has now been made (EP-B-0372628) for this use of the advantage of salts of fatty alkylamines, and more particularly those of fatty alkylpropylenediamines (N-alkyl-1,3-diaminepropanes), which relatively are not very sensitive to the multivalent anions present in industrial water, giving solutions without great turbidity, of good lubricating power and exhibiting excellent antimicrobial properties. These products are supplied in the form of formulations with an essentially aqueous solvent, of which a typical composition (EP-B-0372628, Example 1A) is:

| | |
|---|---|
| cocomonoamine | 5.5% |
| oleyl-1,3-diaminopropane | 6.5% |
| oleylamine oxyethylenated with 15 EO (acting as dispersant) | 2% |
| triethanolamine (acting as dispersant) | 1.5% |
| isopropanol (dissolving agent) | 8.5% |
| acetic acid | 5% |
| water | 71% |

These are relatively not very concentrated compositions, which have the disadvantage of occupying large storage capacities in the factories close to conveyor lines. The stock solutions, when their concentration of fatty amines becomes significant, in practice when it reaches and exceeds 30%, have certain disadvantages: they become pasty and difficult to handle and above all, they are very difficult to dilute, as a result of the formation, in the course of dilution, of gelatinous lumps which only redissolve very slowly, and considerably reduce the useful concentration of the lubricating amine.

DESCRIPTION OF THE INVENTION

What has just been found, and what is the basis of the present invention, is that it is possible to have available concentrated solutions of acetates of N-coco-, N-oleyl- or N-tallow-1,3-diaminopropanes which do not have these disadvantages and which are formed of solutions of acetates of this type in a water/dissolving agent solvent. These solutions are characterized in that

- their diamine acetate content is greater than or equal to 35% by weight,
- the weight ratio of the diamine acetate to the dissolving agent is less than or equal to 4,
- the dissolving agent is taken from the group formed by isopropanol, ethylene glycol, propylene glycol, butylene glycol, hexylene glycol, di(ethylene glycol), di(ethylene glycol)monobutyl ether and 4-hydroxy-4-methyl-2-pentanone (or diacetone alcohol),
- provided that these formulations pass the 100 second dilution test.

This last condition merits some explanation. What the inventors are teaching is that, against every expectation, the formulations thus defined in composition have the desired characteristics of liquidity, clarity and generally do not suffer from dilution troubles. However, because the commercial products are based on diamines whose statistical distribution of the fatty chain lengths and of the level of unsaturation is fluctuating, and since the phase diagrams of the formulations according to the invention can have anomalies for certain composition variants, a selection is to be carried out to eliminate the imperfect formulae. The test for this is the dilution test, which is of extreme simplicity. In particular, the test will respond differently with the N-cocodiamines, the N-oleyldiamines and the tallow diamines, accepting for the latter only compositions formulated with diamine acetate/dissolving agent ratios of appreciably less than 4, or with certain solvents only from the proposed list.

The solutions used for the treatment of bottles (bottling, cleaning, filling, labelling) in the course of their handling on the conveyor lines are generally aqueous dilutions of the compositions according to the invention having an N-alkylpropylenediamine acetate content varying from 0.001 to 1% by weight, and preferably from 0.01 to 0.1% by weight.

EXAMPLES

The following products or assay methods are used in these examples.

a-1: Dilution Water

The water used as dilution water of the stock solutions according to the invention is a deionized water to which is added calcium chloride and magnesium sulphate according to the procedure CNOMOD69 1661, which fixes the hardness at 40°TH (corresponding to a calcium ion content of 8 meq/l).

a-2: Measurement of the Dilution Time

To measure the rate of dilution of concentrated solutions, 10 drops (0.25 g) of this concentrated solution are added to 100 ml of dilution water with gentle stirring. At the surface of the water, the drops tend to form a gel whose disappearance by solubilization is observed visually as a function of time. The time of disappearance of the gel is noted. A concentrated solution is considered as dilutable when this time is less than 100 seconds.

a-3: Measurement of the Tubidity

Measurement with the Haach turbidimeter, expressed in NTU (normalized turbidity units). Measurement is carried out 6 hours after the concentrate has been diluted in water of hardness 40°TH.

a-4: Measurement of the Foam Height

The foam height is measured on solutions diluted in a mechanical mixer operated for 10 seconds. The foam height (in mm) is read 50 seconds later.

a-5: Measurement of the Coefficient of Friction

Measured with a ball+disc tribometer. A 100C6 stainless steel ball is rotated at 1 revolution per minute under a load of 2.6 kg on a glass disc 50 mm in diameter. The friction is measured with the aid of a pressure sensor. A coefficient of friction of 0.40 typically corresponds to pure water.

Example 1

Concentrated Solutions of N-Alkylpropylenediamine Acetates Outside the Field of the Invention The dilution time is measured of compositions made from N-coco-1,3-diaminopropane (Dinoram≦C; CECA S.A.), of N-oleyl-1,3-diaminopropane (Dinoram≦O; CECA S.A.) or of N-tallow-1,3-diaminopropane (Dinoram≦S; CECA S.A.), having the following composition (in % by weight):

| Composition | 1 C | 1 O | 1 CO | 1 S |
|---|---|---|---|---|
| Dinoram ≦ C | 49.2 | | 24.6 | |
| Dinoram ≦ O | | 52.5 | 26.3 | |
| Dinoram ≦ S | | | | 52.7 |
| Acetic acid | 27.0 | 23.6 | 25.3 | 23.7 |
| Isopropanol | 14.3 | 14.3 | 14.3 | 14.2 |
| Water | 9.5 | 9.6 | 9.5 | 9.4 |

The level of salt formation corresponds virtually to the formation of the diamine diacetate. These compositions, although clear and of low viscosity, give rise at the time of their dilution to formation of gelatinous lumps which resist solubilization. The dilution time exceeds 300 seconds. This example is an illustration of the well-established presumption that the concentrated solutions of alkyldiamine salts are very difficult to dilute.

Example 2

Concentrated Solutions According to the Invention

Concentrated solutions are made by adding various quantities of a dissolving agent to the solutions of Example 1, and the dilution time is measured. The compositions and the results are given in the table below.

| | Composition | | |
|---|---|---|---|
| Solution ex. 1 (g) | 1 C:100 | 1 CO:100 | 1 O:100 |
| Solvent (q) | 20 | 30 | 30 |
| | Dilution time (seconds) | | |
| Isopropanol | 29 | 35 | 32 |
| Ethylene glycol | 32 | 140 | 175 |
| Propylene glycol | 40 | 51 | 124 |
| Butylene glycol | 36 | 52 | 52 |
| Hexylene glycol | 20 | 65 | 75 |
| Di(ethylene glycol) | 25 | 97 | 95 |
| Monobutyl ether of di(ethylene glycol) | 33 | 36 | 80 |
| Diacetone alcohol | 40 | 52 | 61 |
| Control (without solvent) | >300 | >300 | >300 |

The table shows how the dilution test allows the compositions which are part of the invention to be discriminated as to their aptitude in the obtainment, without trouble, of an aqueous dilution.

Example 3

Use Properties

The use properties are tested, namely the coefficient of friction, the turbidity and the foam height, on use solutions diluted to 0.05% by weight of diamine acetate, one type being made with concentrated solutions according to the prior art (approximately 16.5% of diamine acetate; compositions 3 C, 3 O and 3 S), the other with concentrated solutions according to the invention (approximately 62.5% by weight of diamine acetate; compositions 3 C*, 3 O* and 3 S*).

All the concentrated solutions tested are clear liquids, whose viscosity is at the most equal to 120 mPa.s.

The diluted solutions were obtained in all cases with a dilution time of less than 100 seconds.

| | According to the prior art | | | According to the invention | | |
|---|---|---|---|---|---|---|
| | 3 C | 3 O | 3 S | 3 C* | 3 O* | 3 S* |
| | Concentrated solutions | | | | | |
| Dinoram C (%) | 11.4 | | | 43 | | |
| Dinoram O (%) | | 11.7 | | | 44.1 | |
| Dinoram S (%) | | | 11.5 | | | 43.6 |
| Acetic acid (%) | 5.1 | 4.8 | 5 | 19.5 | 18.4 | 18.9 |
| Isopropanol (%) | 3.3 | 3.3 | 3.3 | 29.2 | 29.2 | 29.2 |
| Water (%) | 80.2 | 80.2 | 80.2 | 8.3 | 8.3 | 8.3 |
| | Diluted solutions | | | | | |
| Level of dilution (%) | | 0.3 | | | 0.08 | |
| Diamine acetate (%) | | | 0.05 | | | |
| Coefficient of friction | 0.070 | 0.067 | 0.064 | 0.066 | 0.070 | 0.067 |
| Turbidity (NTU) | 5.3 | 0.4 | 9.7 | 2.8 | 0.4 | 7.9 |
| Foam height (mm) | 10 | 5 | 5 | 10 | 11 | 4 |

There is no significant difference in the use properties of the diluted solutions made from various concentrates. All the solutions are satisfactory: the coefficient of friction is reduced, the turbidity is low and they are not very foamy.

What is claimed is:

1. A concentrated solution comprising:

(A) a composition comprising:

(1) one or more acetates of a fatty N-alkylpropylenediamine selected from the group consisting of N-coco-1,3-diaminopropane, N-oleyl-1,3-diaminopropane and N-tallow-1,3-diaminopropane;

(2) at least one alcohol; and (3) water;

(B) a dissolving agent solvent selected from the group consisting of isopropanol, ethylene glycol, propylene glycol, butylene glycol, hexylene glycol, di(ethylene glycol), di(ethylene glycol) monobutyl ether and 4-hydroxy-4-methyl-2-pentanone;

wherein:

(i) the concentrated solution has a diamine acetate content of greater than or equal to 35% by weight;

(ii) the concentrated solution has weight ratio of diamine acetate to the dissolving agent solvent of less than or equal to 4:1; and (iii) the concentrated solution passes a 100 second dilution test.

2. A concentrated solution according to claim 1, wherein the solution comprises from 20 parts to 30 parts by weight of solvent (B) per 100 parts by weight of composition (A).

3. A diluted aqueous solution formed by dilution in water of the concentrated solution of claim 1, wherein the diluted aqueous solution comprises from 0.001 to 1% by weight of the one or more N-alkylpropylenediamine acetates.

4. A diluted aqueous solution according to claim 3, wherein the diluted aqueous solution comprises from 0.01 to 0.1% by weight of the one or more N-alkylpropylenediamine acetates.

5. Method for the treatment of bottles in the course of their handling on conveyor lines comprising treatment with the diluted aqueous solution of claim 3.

6. Method according to claim 5, wherein the treatment is bottling, cleaning, filling, labelling.

* * * * *

UNITED STATES PATENT AND TRADEMARK OFFICE

CERTIFICATE OF CORRECTION

PATENT NO. : 6,569,822 B1
DATED : May 27, 2003
INVENTOR(S) : Francois Guillemet

It is certified that error appears in the above-identified patent and that said Letters Patent is hereby corrected as shown below:

Column 2,
Line 58, change “Tubidity” to -- Turbidity --;

Column 13,
Line 12, change “Dinoram ≦ C;” to -- Dinoram® C; --;
Line 13, change “Dinoram ≦ O;” to -- Dinoram® O; --;
Line 14, change “Dinoram ≦ S;” to -- Dinoram® S; --;
Line 20, change “Dinoram ≦ C” to -- Dinoram® C --;
Line 21, change “Dinoram ≦ O” to -- Dinoram® O --;
Line 22, change “Dinoram ≦ S” to -- Dinoram® S --;

Signed and Sealed this

Twelfth Day of August, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,569,822 B1
DATED : May 27, 2003
INVENTOR(S) : Francois Guillemet

It is certified that error appears in the above-identified patent and that said Letters Patent is hereby corrected as shown below:

Column 2,
Line 58, change “Tubidity” to -- Turbidity --;

Column 3,
Line 12, change “Dinoram ≦ C;” to -- Dinoram® C; --;
Line 13, change “Dinoram ≦ O;” to -- Dinoram® O; --;
Line 14, change “Dinoram ≦ S;” to -- Dinoram® S; --;
Line 20, change “Dinoram ≦ C” to -- Dinoram® C --;
Line 21, change “Dinoram ≦ O” to -- Dinoram® O --;
Line 22, change “Dinoram ≦ S” to -- Dinoram® S --;

This certificate supersedes Certificate of Correction issued August 12, 2003.

Signed and Sealed this

Eighteenth Day of November, 2003

JAMES E. ROGAN
*Director of the United States Patent and Trademark Office*